US008191773B1

(12) United States Patent
Messinger et al.

(10) Patent No.: US 8,191,773 B1
(45) Date of Patent: Jun. 5, 2012

(54) DATA-ENCODED LOTTERY TICKET SCRAPER AND METHOD OF USE

(76) Inventors: Andrew Messinger, Plantation, FL (US); Yasmi Govin, Miami, FL (US)

( * ) Notice: Subject to any disclaimer, the term of this patent is extended or adjusted under 35 U.S.C. 154(b) by 610 days.

(21) Appl. No.: 12/389,891

(22) Filed: Feb. 20, 2009

Related U.S. Application Data

(60) Provisional application No. 61/051,714, filed on May 9, 2008.

(51) Int. Cl.
*G06K 5/00* (2006.01)

(52) U.S. Cl. ..... 235/380; 235/375; 15/236.01; 15/236.06; 15/236.07; 15/236.08

(58) Field of Classification Search ..... 235/375, 235/380; 15/236.01, 236.05, 236.06, 236.07, 15/236.08, 111; D3/211; D32/42, 43, 46
See application file for complete search history.

(56) References Cited

U.S. PATENT DOCUMENTS 5,223,698 A * 6/1993 Kapur ..... 235/375
6,470,574 B1 * 10/2002 Strumke, Jr. ..... 30/169
6,994,262 B1 * 2/2006 Warther ..... 235/492
2002/0152572 A1 * 10/2002 Steinmetz et al. ..... 15/236.01
2008/0110979 A1 * 5/2008 Carnation ..... 235/380

* cited by examiner

*Primary Examiner* — Daniel Hess
*Assistant Examiner* — Tabitha Chedekel
(74) *Attorney, Agent, or Firm* — The Smiley IP Law Group, P.A.; Scott D. Smiley; Mark C. Johnson

(57) ABSTRACT

A data-encoded scraper for cleaning an opaque coating off a scratchcard or lottery ticket is provided. The data-encoded scratchcard scraper includes a scraper body with an integrally formed, or attached, machine-readable encoded data associable with unique end-user-specific data. The machine-readable encoded data preferably comprises barcode symbols.

The scraper body is preferably a flattened, somewhat elongated curvilinear object having a rounded larger end, a rounded smaller end, and a narrow sidewall. The larger end is configured with a thumb-size indentation. The smaller end is configured with a small hole for a key ring. The sidewall is configured with multiple grooves suitable for efficiently scraping the opaque coating from the scratchcard.

The machine-readable encoded data facilitates purchasing, re-loading of funds, collection of end-user-specific data, and presentation of end-user-specific offers, prizes, rewards, directed advertising, and the like.

20 Claims, 4 Drawing Sheets

DATA-ENCODED LOTTERY TICKET SCRAPER AND METHOD OF USE

CROSS-REFERENCE TO RELATED APPLICATION

This Non-Provisional application claims the benefit of U.S. Provisional Patent Application Ser. No. 61/051,714, filed on May 9, 2008, which is incorporated herein in its entirety.

BACKGROUND OF THE INVENTION

1. Field of the Invention

The present invention relates generally to cleaning implements, and more particularly, but not by way of limitation, to a handheld implement configured to comfortably and efficiently clean or scrape an opaque coating off a scratchcard, such as a lottery ticket, while bearing a machine readable code system associable to end-user data.

2. Description of the Prior Art

Many lottery tickets, game cards, and other scratchcards have obscuring or opaque coatings on one or more portions of the card or ticket that overlay printed indicia. The coating is scraped away to expose the indicia, numbers, letters, and/or symbols, underneath, which are used in various manners to determine prizes, awards, or rewards won. Often other portions of the card or ticket have additional areas covered by a surface security covering that must remain unexposed for the authentication and/or verification of the scratchcard. For example, these security coatings might be covering a number assigned to a lottery ticket, and, if the security coating is inadvertently removed, the ticket is voided.

Though fingernails, credit card edges, or coins are often employed to scrape the opaque coating overlying the indicia used to determine any winnings, they are less than satisfactory. They are not of the optimum shape, plus fingernails may be too weak to be effective and the residue under the fingernail is objectionable. Sharp instruments such as pocket knives or razor blades are also sometimes used, but are also unsatisfactory. Sharp instruments increase the risk of an accidental injury to the user or bystander, as well as increasing the risk that the underlying printing will be damaged during the removal, thus voiding the ticket. As none of these devices are configured specifically for scraping lottery tickets, the chance of voiding the ticket by accidental removal of the security covering from the ticket is increased. Additionally none of these devices are configured for comfort of the user. Furthermore, lottery tickets are often purchased in multiples, as they are frequently offered in small denominations, consequently multiplying the laborious task and the discomfort of scratching numerous tickets.

Thus an efficient handheld device to greatly reduce the labor of removing opaque coatings from one or multiple tickets, increase the precision with which the correct portion of the opaque coating can be removed, decreasing the risk of destroying the validity of the ticket, and increasing comfort is advantageous to the end-user.

Another set of advantages, which no currently existing device makes available, could accrue to the issuer of the scratchcard scraper or to other interested commercial institutions, which would often be the state lottery. These advantages would ensue from allowing the issuer to associate particular data with a particular scratchcard scraper and to collect such data. As a consequence, information could be obtained about the ticket buyer's buying habits by noting the number and types of lottery tickets purchased, and personal information could be obtained by registration. Further, the associated data could be utilized to link a bank account, lottery account, or other funding source to this data-encoded scratchcard scraper. This would provide non-cash and pre-paid options for lottery ticket purchases, as well as allowing for automatic replenishment of a lottery account.

Another problem with the current lottery systems is the cost involved in obtaining marketing studies for targeting current and potential customers. It would be advantageous for the issuer to be able to associate particular data with a particular scratchcard scraper and to collect such data. The issuer could save significant amounts of money with the reduction in marketing studies, as direct information would be available on demographics, geographic locations, and purchasing habits of lottery ticket purchasers.

Additionally, the issuer could present customer-specific offers, prizes, rewards, directed advertising, and the like. The issuer could also partner with other local retailers and businesses, piggy-backing on the advertising programs or campaign already being utilized by these entities. In addition advertising space on the scratchcard scraper could be sold to a retailer as a means of generating revenues for the issuer.

Plus, because purchasing lottery tickets could be simplified by associating the data-encoded scratchcard scraper with a funding source, advantages follow to both the customer and to the issuer. The customer would receive the benefit of convenience, as he or she would not have to have enough cash in his or her pocket to pay for the lottery tickets. And the issuer would receive the benefit of increased sales, due to this increased convenience. Also, sales could increase due to the possible psychological effect of lessening resistance to spending money, similarly to what has been reported in studies showing that persons using credit cards are more likely to spend money than those using cash.

Further, with a data-encoded scratchcard scraper the ability to offer pre-paid gift cards could be advantageously created, which no existing device provides.

Accordingly, there is an established need for a scratchcard scraper, as provided in the instant invention, that provides significant advantages to both the customer and to the issuer.

SUMMARY OF THE INVENTION

The present invention is directed to an inexpensive data-encoded scratchcard scraper that is capable of efficiently removing an opaque coating off a scratchcard or lottery ticket, while providing useful end-user-specific data to the issuer of the data-encoded scraper. The data-encoded scratchcard scraper includes a scraper body and a machine readable code system affixed to the scraper body. The machine readable code system is associable with unique end-user-identifying data, and preferably comprises barcode symbols disposed on a carrier.

The scraper body is preferably an easily identifiable, eye-catching, durable, lightweight, flattened, somewhat elongated curvilinear object having a rounded larger end, a rounded smaller end, and a narrow sidewall. The larger end is configured with a thumbprint-shaped indentation. The smaller end is preferably configured with a small hole for a key ring. The sidewall is configured with multiple grooves suitable for efficiently scraping the opaque coating from the scratchcard.

The machine readable code of the data-encoded scratchcard scraper enables the issuer to obtain and use end-user-identifying data, thus allowing the presentation of end-user-specific offers, prizes, rewards, directed advertising, and the like. Further, the machine readable code facilitates purchasing lottery tickets, purchasing of lottery gift cards, and reloading of funds into purchasing accounts.

An object of the present invention is to provide a data-encoded scratchcard scraper that can efficiently remove opaque coating from a particular area of a scratchcard.

A further object of the present invention is to provide a data-encoded scratchcard scraper that is comfortable to use when removing opaque coatings from scratchcards.

An additional object of the present invention is to provide a data-encoded scratchcard scraper that is lightweight.

Another object of the present invention is to provide a data-encoded scratchcard scraper that allows association of customer data with a particular scratchcard.

An additional object of the present invention is to provide a data-encoded scratchcard scraper that provides the issuer a mechanism to obtain the customer data associated with a particular scratchcard.

Another object of the present invention is to provide a data-encoded scratchcard scraper that permits the association of a funding source with a particular scratchcard.

A further object of the present invention is to provide a data-encoded scratchcard scraper that allows end-user-specific offers to be extended.

An additional object of the present invention is to provide a data-encoded scratchcard scraper that has the ability to function as a pre-paid gift card.

These and other objects, features, and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, where like designations denote like elements, and in which.

Like reference numerals refer to like parts throughout the several views of the drawings.

DETAILED DESCRIPTION OF THE PREFERRED EMBODIMENTS

Shown throughout the figures, the present invention is directed toward a useful data-encoded scratchcard scraper that is capable of comfortably and efficiently removing an opaque or obscuring coating from an area of a scratchcard (such as a lottery ticket, game card, or the like), while providing benefits to both the customer and to the issuer from the machine readable code system that is associable with unique end-user-specific data and that is affixed to the scraper body. By providing end-user-specific data to the issuer of the data-encoded scraper, the customer benefits by increased convenience in purchasing scratchcards, by automatic entry into contests and raffles, by receiving rewards, and by receiving personalized offers. The issuer, such as a lottery department of a state lottery or a private vendor, can both increase sales and lower expenses. The issuer can specifically direct offers, prizes, rewards, marketing, and the like to a particular customer. Plus the data-encoded scratchcard scraper is eye-catching, easily identifiable, and distinctive; this results in a subliminal encouragement to purchase lottery tickets, thus further increasing sales for the issuer. Expenses are lowered, as compared to the cost of marketing research and studies, due to the ease of collection of a variety of information, including, for example, personal data, purchase numbers and types, advertising effectiveness, and selling trends. Such personal information is obtained by registration, such as web-based forms, email, postal mail, in-person, or phone registration.

Figure 1:
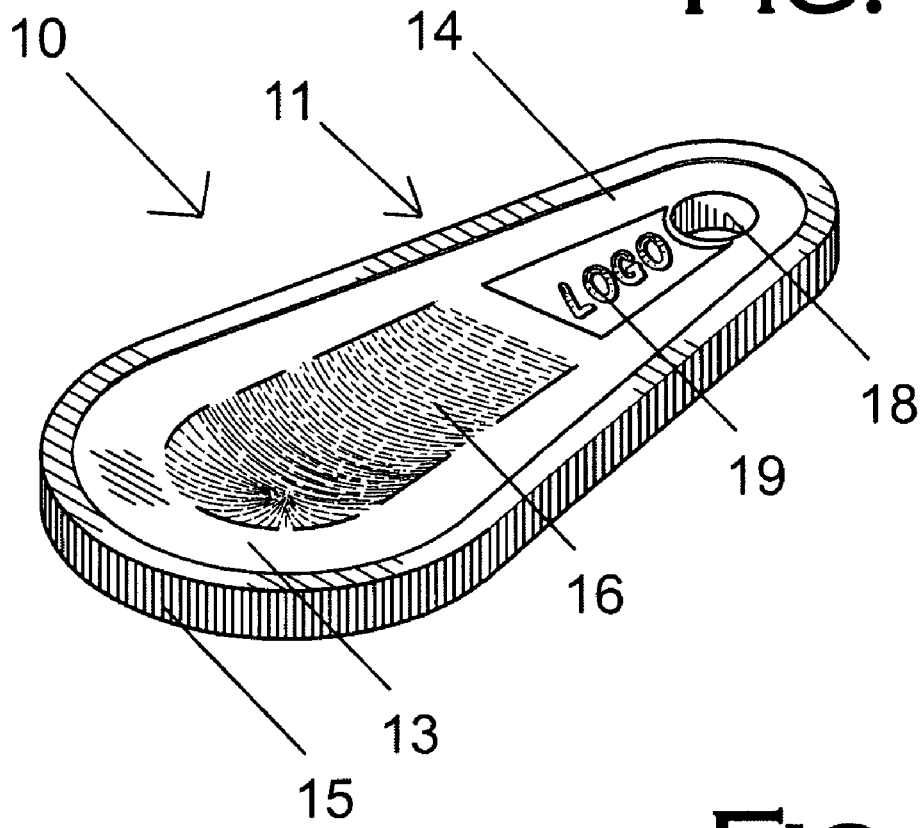
FIG. 1 is a perspective view showing the top of a preferred embodiment of the data-encoded scratchcard scraper of the present invention.
Figure 2:
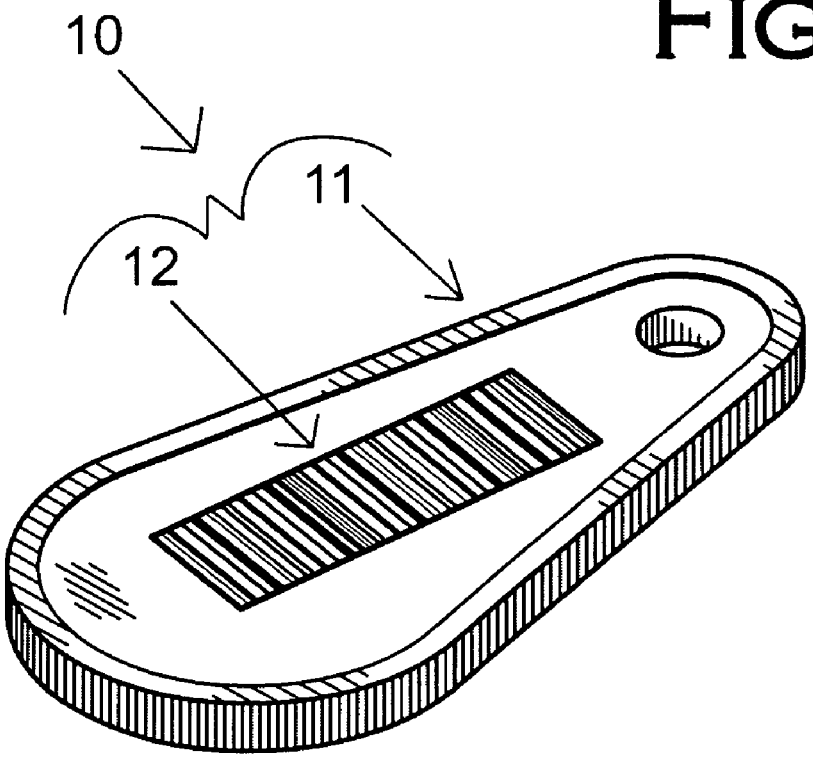
FIG. 2 is a perspective view showing the bottom of a preferred embodiment of the data-encoded scratchcard scraper of the present invention.
Figure 3:
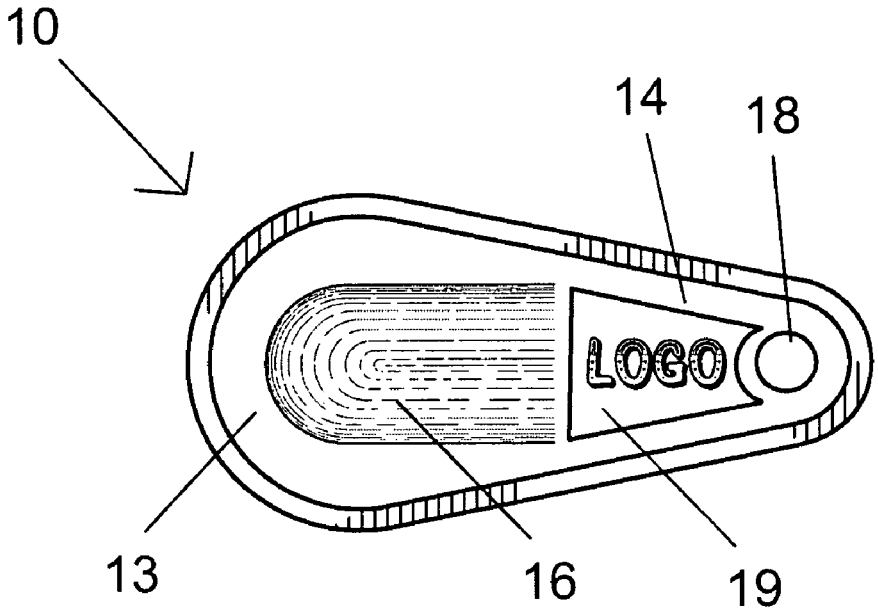
FIG. 3 is a top view showing a preferred embodiment of the data-encoded scratchcard scraper of the present invention.
Figure 4:
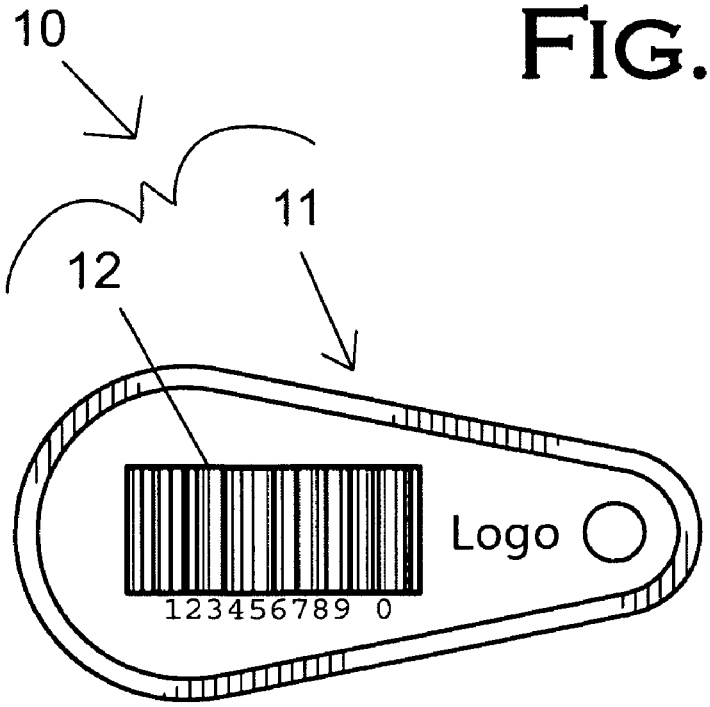
FIG. 4 is a bottom view showing a preferred embodiment of the data-encoded scratchcard scraper of the present invention.

Referring now to FIG. 1 and FIG. 2, a data-encoded scratchcard scraper, shown generally as reference number 10, is illustrated in accordance with a preferred embodiment of the present invention. As shown, the data-encoded scratchcard scraper 10 includes a scraper body 11 and a machine readable code system 12 (FIG. 2).

The scraper body 11 is preferably an easily identifiable, eye-catching, durable, lightweight, flattened, somewhat elongated curvilinear object having a rounded larger end 13, a rounded smaller end 14, and a narrow sidewall 15. The scraper body 11 is preferably colored and/or patterned in an aesthetically pleasing, attractive, and/or attention-getting manner, i.e. a state logo, a private issuer's emblem, or other advertisement. The scraper body 11 is unitarily formed of durable plastic or other polymer, preferably produced via a plastic molding injection system. The upper surface of larger end 13 is configured with a slightly recessed, thumbprint-shaped indentation 16 for easy handling. The indentation 16 may have a textured surface, such as a grooved surface, for example, to aid in gripping and prevent slippage. The thumbprint-shaped indentation 16 is sized and configured to fit an average thumb and to provide a comfortable surface for the thumb to rest upon while using the scraper to remove the opaque coating. The smaller end 14 is preferably configured with a small hole 18, sized to accommodate a standard key ring. Providing for carrying the data-encoded scratchcard scraper 10 on a key ring potentially increases lottery sales by subliminally reminding the customer (or bystanders) to purchase lottery tickets when the keys or the data-encoded scratchcard scraper 10 are viewed. Optionally, for the convenience of the customer, the data-encoded scratchcard scraper 10 may be hung on a hook inserted through small hole 18 or may be carried in a pocket or bag.

Figure 5:
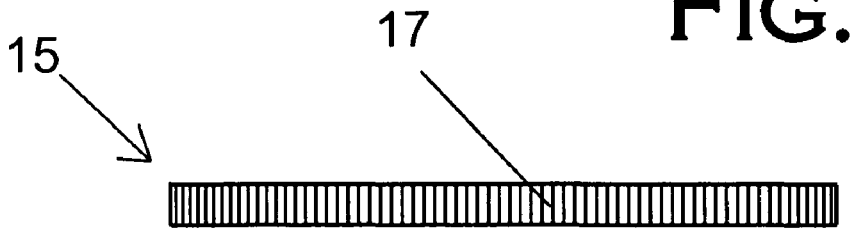
FIG. 5 is a side view showing a preferred embodiment of the data-encoded scratchcard scraper of the present invention.
Figure 6:
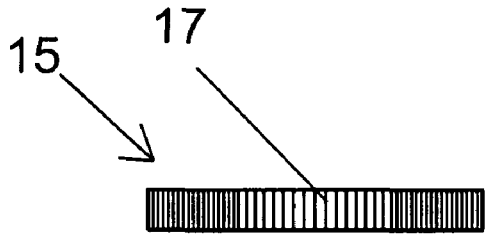
FIG. 6 is a front view showing a preferred embodiment of the data-encoded scratchcard scraper of the present invention.
Figure 7:
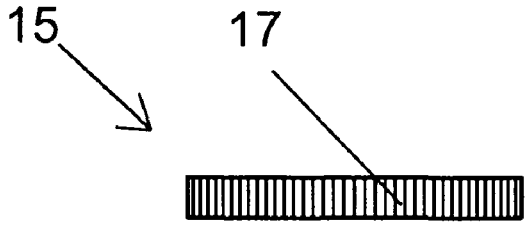
FIG. 7 is a back view showing a preferred embodiment of the data-encoded scratchcard scraper of the present invention.
Figure 8:
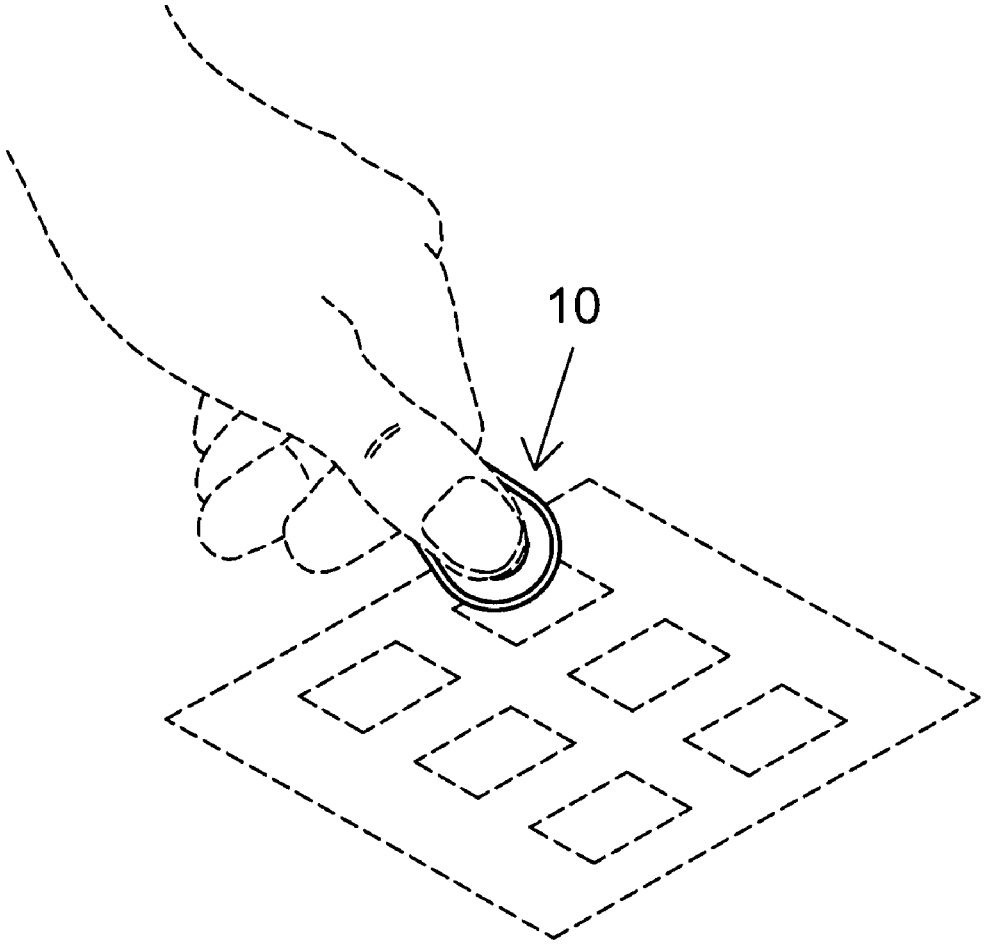
FIG. 8 is a perspective view showing a preferred embodiment of the data-encoded scratchcard scraper of the present invention being utilized to remove the opaque coating from a scratchcard.

Referring now to FIG. 5, FIG. 6, FIG. 7, the sidewall 15 is configured with multiple ridges, scales, or grooves 17 suitable for efficiently scraping the opaque coating from the scratchcard. Grooves 17 are formed integrally with the scraper body 11, and may be vertical grooves (as shown), horizontal grooves, or diagonal grooves. Grooves 17 may be uniform or may vary in width. The grooves 17 are configured to accurately and effectively remove the opaque coating from the scratchcard, as illustrated in FIG. 8.

A promotional element 19 is provided. Promotional element 19 comprises a logo, advertising, marketing display, graphic, or the like, which may promote furtherance of sales or brand identity or commercial distinction. For instance, promotional element 19 may be a state lottery logo printed on a carrier, such as an adhesively attachable label. The state lottery logo then could be easily varied by substituting the correct label to correspond to the state for which the lottery ticket was issued. The state lottery logo would be both an advertisement and a subliminal marketing message increasing player participation and increasing revenue to the state lottery. Optionally, the promotional element 19 may be formed integrally with scraper body 11, for example with a raised logo, symbol, or graphic. Promotional element 19 may be disposed on a top surface of scraper body 11, as shown, or alternatively, on the bottom surface near the machine readable code system 12 (not shown), or on both top and bottom surface of the scraper body 11, or other suitable location.

The machine readable code system 12 comprises machine-readable encoded data, and optionally, additionally comprises a carrier upon which the machine-readable encoded data is disposed. In the interest of economy, preferably the machine-readable encoded data is in the form of barcode symbols disposed on a carrier, scannable with a barcode reader. The carrier is preferably adhesively attachable, and may be formed of any conventional material, such as paper, plastic, or a composite material. The carrier may be affixed at the general location illustrated in FIG. 2 on the bottom side of scraper body 11, or, alternatively, may be affixed on the top surface (not shown). The barcode symbols comprise traditional linear barcodes, matrix codes and other 2D barcodes, stacked barcodes, and the like. The machine readable code system 12 may alternatively comprise other conventional machine-readable encoded data, such as an RFID tag or a magnetic stripe. The machine readable code system 12 may alternatively be integrally formed with the scraper body 11 at the time of manufacture, as opposed to carrier-based.

The machine readable code system 12 allows the data-encoded scratchcard scraper 10 to be uniquely identified, and thus to be associable with unique end-user-identifying, end-user-specific data. This is advantageous as it allows the linking of the data-encoded scratchcard scraper 10 with a bank account, lottery account, or other funding source. This would provide non-cash and pre-paid options for lottery ticket purchases, as well as allowing for automatic replenishment of a lottery account. The customer no longer needs to carry cash to fund his or her lottery card purchases, as the money can be withdrawn from a lottery account, thus providing convenience to the customer. This simplification of lottery ticket purchases also provides the issuer the benefit of increased sales.

The end-user-specific data comprises both end-user-specific usage information and end-user-specific personal information. The end-user-specific usage information can be obtained about the ticket buyer's purchasing habits by noting the locations, number, and types of lottery tickets purchased. End-user-specific personal information can be obtained by registration of the unique machine readable code system 12 on a specific data-encoded scratchcard scraper 10 to a particular person, including one or more of the fields of name, address, age, occupation, interests, email address, income, ethnic group, education, and the like. Registration can be done online, by mail, by phone, or in person, allowing the collection of any desired personal data or survey answers. This registration allows direct collection of demographic, personal, usage, and geographic data and facilitates correlation with purchasing habits. Advantages accruing to the issuer include savings on the cost of marketing studies, increased partnering possibilities, increased ease of directed marketing, increased sales, and an increased number and types of games or prizes which can be offered. The issuer can present end-user-specific offers, prizes, rewards, directed advertising, and the like. The issuer can reward frequent purchasers with additional prizes and raffles. The machine readable code system 12 additionally provides a system whereby the customer can be automatically entered into random lottery raffles or contests. The lottery establishment can devise new, interesting, and appealing games, raffles, prizes, and rewards using the newly acquirable data, which creates buzz and increases lottery ticket sales.

The issuer can partner with local retailers and businesses, piggy-backing on the advertising programs or campaigns already being utilized by these entities. For example, a partnership with a grocery store or gasoline station, will allow the player to win free groceries or free gasoline. Or the issuer can promote community services or state agencies through donations or through taxes paid on winnings, such as, for instance, the issuer can emphasize enhancements in educational quality when a portion of the purchase price of the lottery ticket is funneled to the educational system of the state of issue; or the issuer may promote goodwill and assistance to the elderly by donating a portion of the purchase price; or the issuer may devote a portion of the proceeds to conservation efforts. The promotional element 19 provides advertising space on the scratchcard scraper that can be sold to a retailer as a means of generating revenues for the issuer.

Further, the data-encoded scratchcard scraper 10 creates the ability to offer both a zero-dollar value data-encoded scratchcard scraper and a pre-paid gift-card-type data-encoded scratchcard scraper, as the machine readable code system 12 can be used to pre-load the data-encoded scratchcard scraper 10 with a specific dollar amount of money. Moreover, additional funds can be added at a retailer, over the Internet, by postal mail, in person, or by phone. Optionally, the user can establish an auto-replenishment feature, whereby additional funds are automatically replenished at a pre-set dollar value.

The data-encoded scratchcard scraper 10 can be offered for purchase (or dollar value added) at retail stores, on-line via the Internet, by postal mail, or via the telephone. The data-encoded scratchcard scraper 10 can be easily incorporated into existing lottery department's marketing and advertising concepts and campaigns, and used to expand these concepts and campaigns.

From the foregoing, it will be apparent that the data-encoded scratchcard scraper 10 of the current invention efficiently and comfortably removes the opaque coating from a scratchcard, while providing numerous significant benefits to both the customer and to the issuer.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

We claim:

1. A scraper manually operated by an end-user to scrape an obscuring surface from a scratchcard, comprising:

a scraper body configured as a flattened, somewhat elongated curvilinear object having a rounded larger end, a rounded smaller end, an upper surface, a bottom surface, and a narrow vertical sidewall, wherein said upper surface is configured with an thumbprint-shaped indentation sized and configured to generally fit a thumb of said end-user, and wherein said sidewall is configured with multiple grooves; and a machine readable code system configured to encode machine-readable end-user-identification-specific data.

2. The scraper manually operated by an end-user to scrape an obscuring surface from a scratchcard, as recited in claim 1, further comprising a promotional element, and wherein said rounded smaller end is configured with a small hole sized to accommodate a key ring.

3. The scraper manually operated by an end-user to scrape an obscuring surface from a scratchcard, as recited in claim 2, wherein said promotional element is attached to said upper surface.

4. The scraper manually operated by an end-user to scrape an obscuring surface from a scratchcard, as recited in claim 2, wherein said promotional element is attached to said bottom surface.

5. The scraper manually operated by an end-user to scrape an obscuring surface from a scratchcard, as recited in claim 2, wherein said promotional element is formed integrally with said scraper body.

6. The scraper manually operated by an end-user to scrape an obscuring surface from a scratchcard, as recited in claim 2, wherein said promotional element comprises a logo.

7. The scraper manually operated by an end-user to scrape an obscuring surface from a scratchcard, as recited in claim 2, wherein said promotional element comprises advertising.

8. The scraper manually operated by an end-user to scrape an obscuring surface from a scratchcard, as recited in claim 2, wherein said machine readable code system is formed integrally with said scraper body.

9. The scraper manually operated by an end-user to scrape an obscuring surface from a scratchcard, as recited in claim 2, wherein said machine readable code system comprises a carrier, wherein said carrier is attached to said scraper body.

10. The scraper manually operated by an end-user to scrape an obscuring surface from a scratchcard, as recited in claim 9, wherein said machine readable code system comprises barcode symbols disposed on said carrier.

11. The scraper manually operated by an end-user to scrape an obscuring surface from a scratchcard, as recited in claim 9, wherein said machine readable code system comprises an RFID tag.

12. A method of use of a scraper for scraping a scratchcard, comprising:

obtaining a scratchcard scraper comprising a machine readable code system, wherein said machine readable code system is associated with unique end-user-identification-specific data;

interacting with at least one commercial institution by using said machine readable code system;

positioning a sidewall of said scratchcard scraper near an opaque coating on a surface of said scratchcard; and rubbing said sidewall of said scratchcard scraper across said opaque coating.

13. The method of use of a scraper for scraping a scratchcard, as recited in claim 12, wherein: said at least one commercial institution comprises a lottery establishment; and said interacting with at least one commercial institution comprises collecting said unique end-user-identification-specific data.

14. The method of use of a scraper for scraping a scratchcard, as recited in claim 13, further comprising receiving a prize entry associated with said unique end-user-identification-specific data.

15. The method of use of a scraper for scraping a scratchcard, as recited in claim 14, wherein said at least one commercial institution further comprises a banking institution; and wherein said method of use of a scraper for scraping a scratchcard further comprises: associating a specific account at said banking institution with said unique end-user-identification-specific data; and deducting an amount from said specific account at said banking institution to be credited to said scratchcard scraper.

16. The method of use of a scraper for scraping a scratchcard, as recited in claim 15, further comprising receiving offers from said lottery establishment based on said unique end-user-identification-specific data.

17. A method of use by a commercial institution of a scratchcard scraper configured with machine-readable encoded data, comprising:

providing said scratchcard scraper to an end-user to use to remove an opaque coating from a surface of a scratchcard;

obtaining end-user-identification-specific personal information from said unique end-user;

associating said end-user-identification-specific personal information with said machine-readable encoded data;

offering prize entries based on said machine-readable encoded data; and funding lottery purchases based on said machine-readable encoded data.

18. The method of use by a commercial institution of a scratchcard scraper configured with machine-readable encoded data, as recited in claim 17, further comprising directing marketing to said end-user based on said machine readable encoded data.

19. The method of use by a commercial institution of a scratchcard scraper configured with machine-readable encoded data, as recited in claim 18, wherein said scratchcard scraper comprises a promotional element configured to promote brand identity.

20. The method of use by a commercial institution of a scratchcard scraper configured with machine-readable encoded data, as recited in claim 19, further comprising preloading said scratchcard scraper with a specific monetary value, wherein said scratchcard scraper can function as a gift card.

* * * * *